US009171693B2

(12) United States Patent
Hemberg et al.

(10) Patent No.: US 9,171,693 B2
(45) Date of Patent: Oct. 27, 2015

(54) COATED X-RAY WINDOW

(75) Inventors: Oscar Hemberg, Kista (SE); Tomi Tuohimaa, Kista (SE)

(73) Assignee: EXCILLUM AB, Kista (SE)

( * ) Notice: Subject to any disclaimer, the term of this patent is extended or adjusted under 35 U.S.C. 154(b) by 243 days.

(21) Appl. No.: 13/885,759

(22) PCT Filed: Dec. 3, 2010

(86) PCT No.: PCT/EP2010/068843
§ 371 (c)(1),
(2), (4) Date: May 16, 2013

(87) PCT Pub. No.: WO2012/072146
PCT Pub. Date: Jun. 7, 2012

(65) Prior Publication Data
US 2013/0235979 A1 Sep. 12, 2013

(51) Int. Cl.

| | |
|---|---|
| ***H05G 1/08*** | (2006.01) |
| ***H01J 35/02*** | (2006.01) |
| ***H01J 35/18*** | (2006.01) |
| ***H01J 35/08*** | (2006.01) |
| *H01J 35/00* | (2006.01) |

(52) U.S. Cl.
CPC ..... *H01J 35/18* (2013.01); *H01J 35/025* (2013.01); *H01J 35/08* (2013.01); *H01J 35/00* (2013.01); *H01J 35/02* (2013.01); *H01J 2235/082* (2013.01); *H01J 2235/168* (2013.01); *H01J 2235/183* (2013.01); *H05G 1/08* (2013.01)

(58) Field of Classification Search
CPC ..... H05G 1/08; H01J 35/00; H01J 35/02; H01J 35/025; H01J 35/04; H01J 35/18; H01J 2235/00; H01J 2235/02; H01J 2235/12; H01J 2235/122; H01J 2235/1225; H01J 2235/1291; H01J 2235/1295; H01J 2235/18; H01J 2235/183
USPC ..... 378/91, 119, 121, 140–143
See application file for complete search history.

(56) References Cited

U.S. PATENT DOCUMENTS 6,005,918 A 12/1999 Harris et al.

FOREIGN PATENT DOCUMENTS

JP 62-036546 A 2/1987
JP 62-64949 U 4/1987

(Continued)

OTHER PUBLICATIONS

International Search Report (PCT/ISA/210) issued on Aug. 19, 2011, by the European Patent Office as the International Searching Authority for International Application No. PCT/EP2010/068843.

(Continued)

*Primary Examiner* — Anastasia Midkiff
(74) *Attorney, Agent, or Firm* — Buchanan Ingersoll & Rooney P.C.

(57) ABSTRACT

An X-ray window including a primary and a secondary window element. In order to evaporate debris by ohmic heating, current flows through the secondary (upstream) window element. Meanwhile, electric charge originating from electron irradiation and/or depositing charged particles is to be drained off the window element. To prevent large debris particles from short-circuiting the window element and changing the desired heating pattern, the current for heating the window element flows through a layer which is insulated from the charge-drain layer.

20 Claims, 4 Drawing Sheets

(56) References Cited

FOREIGN PATENT DOCUMENTS

| | | | |
|---|---|---|---|
| JP | H06-102214 | A | 4/1994 |
| JP | H07-280748 | A | 10/1995 |
| JP | H08-138613 | A | 5/1996 |
| JP | 2008-277481 | A | 11/2008 |
| JP | 5108367 | B2 | 12/2012 |
| WO | WO 2010/083854 | A1 | 7/2010 |

OTHER PUBLICATIONS

Written Opinion (PCT/ISA/237) issued on Aug. 19, 2011, by the European Patent Office as the International Searching Authority for International Application No. PCT/EP2010/068843.

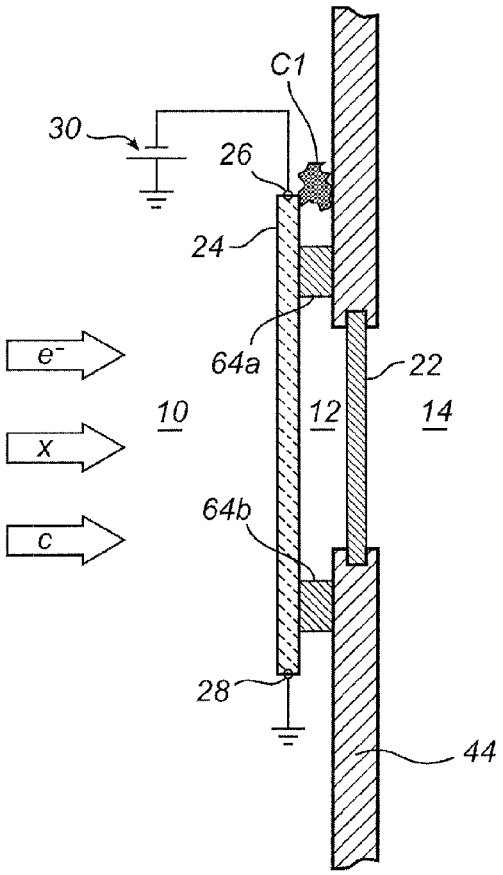
(Prior art) Fig. 1
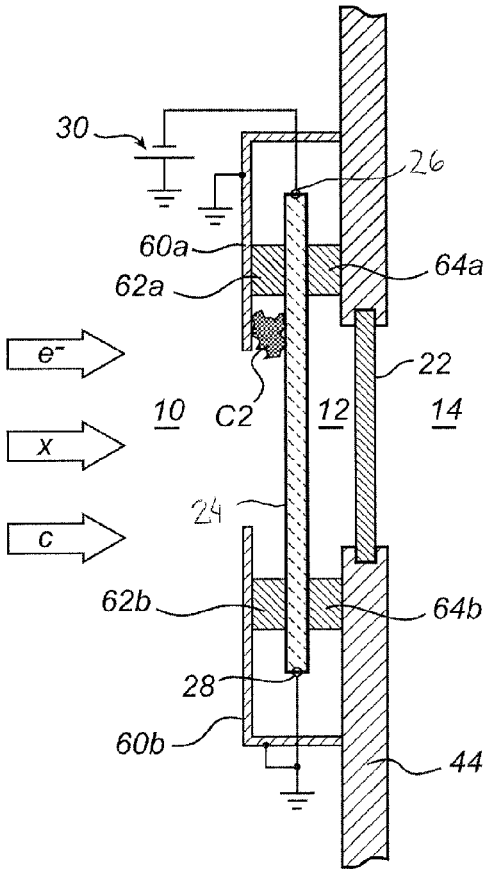
(Prior art) Fig. 2

COATED X-RAY WINDOW

TECHNICAL FIELD OF THE INVENTION

The invention disclosed herein generally relates to the installation of electron-impact X-ray sources. More particularly, it relates to an X-ray window suitable as a part of a vacuum casing for an X-ray generation arrangement including a liquid-jet anode.

BACKGROUND OF THE INVENTION

The co-pending International Application published as WO 2010/083854, which is incorporated herein by reference, discloses a self-cleaning window arrangement for separating atmospheric pressure from vacuum while letting X-ray radiation pass through. The window arrangement has heating means for cleaning an inner surface, facing the vacuum, in order to evaporate a contaminant during operation. In particular, the window can be cleaned from splashes, droplets and depositing mist from the liquid-jet anode.

SUMMARY OF THE INVENTION

It is an object of the present invention to propose an X-ray window with an improved robustness against contamination. A particular object is to propose an X-ray window with a robust self-heating functionality.

An X-ray window, for separating an ambient pressure region from a reduced pressure region, comprises:

- a primary X-ray-transparent window element separating the ambient pressure region from an intermediate region;
- a secondary window element separating the intermediate region from the reduced pressure region and having a side facing the reduced pressure region for receiving a contaminant depositing thereon; and
- heating means for applying an electric voltage between areas of the secondary window element for thereby evaporating contaminant having deposited thereon.

Such a window may be provided in the wall of a vacuum or near-vacuum chamber (reduced pressure region) of an X-ray source and allows generated X-rays to leave the chamber while preserving the necessary (near-)vacuum conditions. In the case of an X-ray source with a jet of liquid metal, the contaminant may be metal debris from the anode. Even though debris accumulates on the secondary window element during normal operation of the X-ray source, it is possible to conveniently clean the secondary window element according to the invention without disassembling the X-ray source or releasing the vacuum, or without even interrupting normal operation of the source.

The inventors have realised that a window of the kind described is susceptible of a failure condition in which a debris particle establishes an electrical and/or thermal connection with an element adjacent to the window. As shown in FIG. 1, a debris particle C1 is located between a housing 44 and an electrically heated secondary window element 24 forming the inner surface. If the housing 44 is earthed, a portion of the current provided by source 30 may escape through the particle C1 instead of heating the secondary window element 24. Even if the housing 44 is electrically insulated, as the case may be, the particle C1 will act as a heat sink and cause the secondary window element 24 to deviate from the intended temperature distribution. This will hamper the self-cleaning action of the window.

FIG. 2 illustrates a failure condition in a window arrangement comprising a charge-absorbing screen 60 surrounding the secondary window element 24. The screen 60 may be useful in applications where the window boundary and equipment associated thereto requires protection from electron or X-ray irradiation or from contaminant. To allow the ohmic heating of the secondary window element 24 to proceed orderly and to conserve the heat produced, the window element 24 is separated from the screen 60 by thermally and electrically insulating spacers 62. A contaminant particle C2 located between the secondary window element 24 and the screen 60 will create an undesirable electric and/or thermal connection between these elements. In particular, the electric current flowing from the current source 30 may concentrate in a short segment from a connection point 26 up to the particle C2. Therefore, since the particle C2 itself renders the heating less efficient, it may take the window considerable time to recover from the failure condition.

In view of these shortcomings, the invention provides an X-ray window in accordance with claim 1. Advantageous embodiments are defined by the dependent claims. In a first aspect, the secondary window element comprises:

- an electrically insulating layer;
- a charge-drain layer, which faces the reduced-pressure region and is connected to a charge sink; and
- a heater layer, which is electrically insulated from the charge-drain layer, wherein said areas, between which the voltage is applied, are located in the heater layer.

Hence, the invention is based on the realisation that the secondary window element in the prior art window is responsible for charge transport of two different types—both the ohmic heating to evaporate debris and the draining of charge transmitted to the element by charged debris particles or direct electron irradiation—and, further, that it is advantageous to separate the two types of charge transport. If the two types of charge transport take place in separate layers, such as a heater layer and a charge-drain layer, the heater layer can be located where it is protected from deposition of debris that would otherwise be likely to perturb its functioning. The invention will correct the failure condition shown in FIG. 2 faster than the prior art, because the ohmic heating will continue to operate despite the undesired electric connection through the debris particle C2 between the screen 60 and the secondary window element 24. Likewise, the failure condition shown in FIG. 1 can be easily forestalled by the invention, which may be embodied using a secondary boundary element on which the heater layer ends a distance from the boundary, which is the portion most exposed to debris.

For the purpose of this disclosure and particularly the claims, the terms "debris" and "contaminant" are used interchangeably. It is understood that the "electrically insulating layer" may have high or low thermal conductivity, depending on the intended application. If for instance debris depositing on the axially opposite side of the window element is to be removed, then the electrically insulating layer preferably has high (axial) thermal conductivity. On the other hand, if debris is to be evaporated on an element in thermal contact with the heater layer but not on the axially opposite side of the window element (e.g., if the secondary window element is partially non-transparent to X rays), then it is more economical to select an electrically insulating material that is also thermally insulating. Further, the "charge-drain layer" is adapted to drain electric charge from the window element, so as not to become electrostatically charged to any significant extent. To achieve this, the charge-drain layer may be on any suitable electric potential, such as earth potential, a constant non-earth potential (either attractive or repulsive in relation to the electrons) or a fluctuating potential. Further, the charge-drain layer is electrically conductive, at least in a transversal direction of the secondary window element, so that electric charge can be drained off the window element and proceed to the charge sink. Finally, the "heater layer" may be a solid or non-solid element, covering the whole or a portion of the secondary window element. The heater layer may be a thin layer of a material which is electrically conductive at least in a transversal direction of the window element.

The invention may be embodied as an unscreened window, similarly to FIG. 1. This provides a simple and efficient construction, which can nevertheless be made robust by arranging the heater layer in a position sheltered från debris splashes, such as by letting it end a distance from the boundary of the secondary window element.

In one embodiment, the secondary window element is at least partially surrounded by a screen on the side facing the reduced-pressure region. Preferably, the screen acts as a charge drain by being connected to a charge-absorbing body (or charge sink, e.g., earth) and by being electrically conductive. The screen shelters the edges, mechanical securing means and electric connections, if any, of the secondary window element against direct exposure to debris, including splashes or travelling droplets.

In one embodiment, the secondary window element is surrounded by a charge-draining screen and the charge-drain layer of the secondary window element is connected to the screen by being fitted to it via a thermally insulating spacer. The spacer is in electrical contact with both the screen and the charge-drain layer of the window element. The spacer itself is sufficiently electrically conductive to drain off the charge impinging on the secondary window element. Typically, the charge impinging on the window element is of the order of micro-amperes. It is economical to insulate the secondary window element thermally, since less heating power will be needed, and the use of a weaker heating current will increase the working life of the heater layer.

In one embodiment, the secondary window element is surrounded by a charge-draining screen and is fitted to this via a thermally and electrically conducting spacer. To achieve the desired draining of charge from the charge-drain layer, this layer is connected to the screen via a filament. The filament is preferably slack so as to accommodate thermal expansion of the secondary window element and/or the screen.

In one embodiment, the charge-drain layer does not extend outside the insulating layer, whereas the heater layer extends outside the charge-drain layer, at least by a positive distance in a transversal direction of the window element. The insulating layer may be flush with the heater layer or with the charge-drain layer, or may extend outside the charge-drain layer but not up to the heater layer. The differences in size make the electric insulation of the layers more robust. They may also simplify the electric and mechanical fastening of the secondary window element, since a portion of it can be inserted into a slit in a reservoir with electrically conducting liquid. Such fastening may be achieved similarly to FIG. 3 of WO 2010/083854. It secures the window element axially and may secure it in some transversal directions as well. Advantageously, the secondary window element is allowed to expand and contract in response to temperature changes. If two segments of the boundary of the window element are inserted into slits in different reservoirs, a current for ohmic heating may be driven through the heater layer. If the heater layer and the electrically insulating layer are flush with one another at the edge, both may be inserted into the slit in the container.

In a variation to this embodiment, the heater layer does not extend outside the insulating layer, and the charge-drain layer extends at least a positive distance outside the heater layer. The insulating layer may be flush with either external layer, or may end between the respective boundaries of the heater layer and the charge-drain layer. This geometry applies at least over a portion of the boundary of the secondary window element. Since the charge-drain layer constitutes the outermost portion of the secondary window element in said portion, it is convenient to secure this layer by inserting it into a slit in a reservoir, where it makes contact with an electrically conducting liquid. If the charge-drain layer and the electrically insulating layer are flush with one another, both may be inserted into the slit in the container. Preferably, the liquid is in turn electrically connected to a charge sink. It is possible though not necessary to connect more than one boundary segment of the window element by insertion into a slit, since both the thermal expandability and the charge-draining capacity will already be achieved by one.

In one embodiment, the electrically insulating layer constitutes the outermost portion of the secondary window element, at least over a portion of its boundary. In this portion, more precisely, the electrically insulating layer may extend a first distance outside the heater layer and a second distance outside the charge-drain layer, wherein the first and second distances refer to a transversal direction of the window element. This makes the secondary window element easy to mount, since electric insulation of the fastening means is not imperative. If additionally the electrically insulating layer is thermally insulating, the mounting may become even simpler, since it the fastening means need not be free from thermally conductive material (e.g., metal) where this is convenient.

In one embodiment, the secondary window element is X-ray transparent. Put differently, the window element absorbs radiation in the X-ray wavelength range only to a limited extent. The design choice of window materials with an acceptable X-ray absorbance may be influenced by other properties of the materials, such as electric conductivity, thermal conductivity, mechanical strength, resistance to wear, production engineering aspects etc. Thus, the heated portion of the secondary window element should include at least a central portion, corresponding to the location where the X-ray beam passes through the window element.

In one embodiment, the secondary window element is not necessarily X-ray transparent in the sense discussed above. This allows the materials of the window element to be chosen with greater latitude. To let through the X-ray radiation, it comprises at least one hole. To prevent debris from reaching the primary window element, the hole is provided by an X-ray transparent cover. The cover may also act as a pressure break between the reduced-pressure region and the intermediate region. The hole extends substantially in the axial direction. It may be straight or shaped after the ray cone originating from the interaction region, that is, slightly widening in the ray direction. The cover is preferably in thermal contact with the heater layer, either directly or via the other layers of the secondary window element. The cover may overlap the hole aperture on the side of the reduced-pressure region. The cover may also overlap the hole on the side of the intermediary region; this latter mounting is preferable in view of efficient heating of the cover element.

It is noted that the invention relates to all combinations of features disclosed herein, even if they are recited in mutually different claims.

BRIEF DESCRIPTION OF THE DRAWINGS

Preferable embodiments of the invention will now be described in greater detail with reference to the accompanying drawings, on which:

FIGS. 1 and 2 show prior art X-ray windows in two different failure conditions;

Like reference numerals are used for like elements on the drawings. Unless otherwise indicated, the drawings are schematic and not to scale.

DETAILED DESCRIPTION OF EMBODIMENTS

Figure 3:
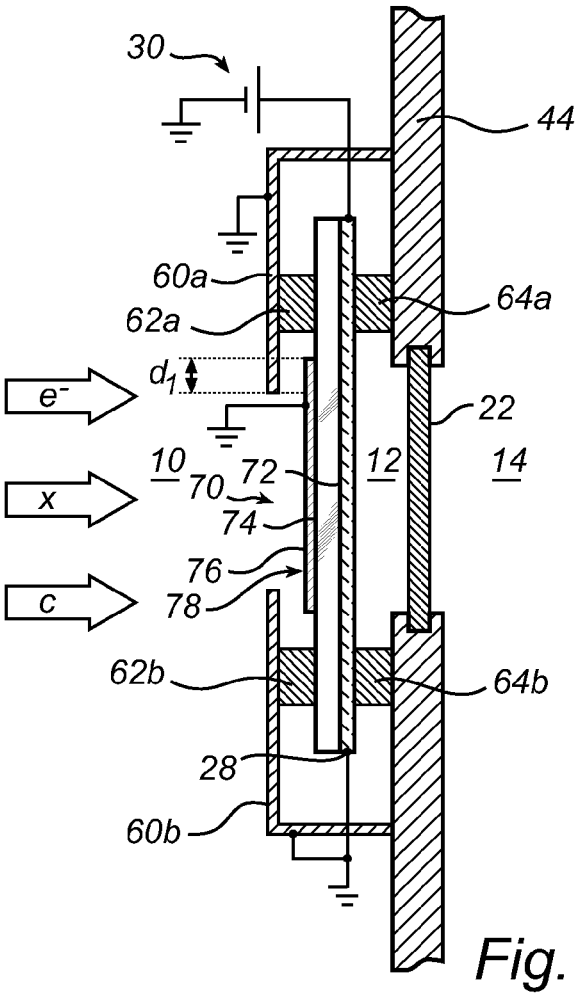
FIG. 3 is a cross-sectional side view of a partially screened X-ray window according to an embodiment of the invention.

FIG. 3 is a cross-sectional view of an X-ray window according to an embodiment of the invention. The figure is partially diagrammatic insofar as an electric current source 30 and several connections to earth are shown symbolically and without regard to their positions in a physical embodiment of the invention. An intended use of the window is the provision of a vacuum-proof X-ray aperture in the housing of an X-ray source. The window arrangement separates a reduced pressure region 10 and an ambient pressure region 14. The reduced pressure region 10 may be the inside of a gas-tight (vacuum-tight) housing 44, which contains equipment for X-ray generation and which, together with a primary window element 22 of the X-ray window, separates this from the environment. During operation of the X-ray generation equipment, the reduced pressure region 10 may be at vacuum or near-vacuum pressure, such as between $10^{-9}$ and $10^{-6}$ bar. As an anode of the X-ray source, a liquid-metal jet (not shown) may be continuously ejected from a nozzle (not shown) during operation.

The window comprises two substantially parallel window elements: the primary window element 22 and a secondary window element 70. The primary and secondary window elements enclose an intermediate region 12. A contaminant C is expected to deposit on that side 78 of the secondary window element 70 which faces the reduced pressure region. The contaminant C may reach the secondary window element 70 in the form of vapour, suspended particles or droplets, or as splashes. Suitable materials for the primary window element 22 include beryllium, which is X-ray transparent at useful thickness values. As opposed to the secondary window element 70, the primary window element 22 does not need to be heat-resistant. The primary window element 22 is secured to the gas-tight housing 44. To allow for thermal expansion, the secondary window element 70 is secured with a clearance at each edge; similar clearances may be provided at those edges of the secondary window element 70 which are located outside the plane of the drawing. It is noted that each of the clearances also acts as a heat insulation between the secondary window element 70 and the housing 44. As an additional heat-conserving measure, the portion of the housing 44 which surrounds the X-ray window may consist of a material with low thermal conductivity. It is advantageous to reduce the heat flux away from the secondary window element 70, because less energy will need to be supplied in order to keep the window element 70 (or a portion thereof) at the desired temperature. This also reduces the need for cooling the X-ray source in the region where the X-ray window is provided.

In this embodiment, the window further comprises a screen 60 covering the top and bottom edges of the secondary window element and thereby protecting sensitive equipment arranged along the edge, including electrical connecting means 26, 28 and the current source 30 if this is located under the screen 60. The screen 60 may cover the right and/or left side (as seen in the axial direction) as well, and may then be manufactured in one piece. Starting from a sheet of metal, preferably corrosion-proof metal such as stainless steel, the screen may be manufactured by punching a hole and subsequently bending the sheet to form edges and corners. In this embodiment, the screen 60 is earthed to avoid a build-up of electric charge.

The secondary window element 70 comprises three layers: a supporting electrically insulating middle layer 74, a charge-drain layer provided on a portion of the side 78 of the element 70 that faces the upstream direction, that is, into the reduced-pressure region 10, and a heater layer 72 facing the downstream direction and being connected at points 26, 28 to the electric current source 30, whereby ohmic heating can be achieved. In this embodiment, the earthed charge-drain layer 76 does not extend over the whole left side 78 of the secondary window element 70, but only slightly outside the axial projection of the aperture defined by the screen 60. More precisely, the charge-drain layer 76 may extend a distance d1 outside the projection, wherein this distance d1 may be chosen while taking into account the axial distance between the screen 60 and the left side 78 and the maximal angle under which charged debris C or electrons $e^-$ are expected to impinge. Thus, it is the insulating layer 74 and the heater layer 72 together, which typically may have a total thickness of 20 μm, that form the upper and lower boundaries of the window element 70. These upper and lower boundaries are secured between spacers 62, 64, which are preferably made of a heat-insulating material, such as $Al_2O_3$ or a machineable ceramic material such as Macor™. Because the right side of the window element 70 is electrically conducting and subject to ohmic heating, the right spacer 64 is preferably electrically insulating as well. If the screen 60 surrounds the secondary window element 70 completely, the spacers may have a closed shape, such as a ring shape, extending in a vertical plane perpendicular to the drawing.

Since the secondary window element 70 will typically not be subject to large local voltages, the electrically insulating layer 74 need not be designed for high breakdown voltages and can thus be made comparatively thin. This implies that a wide range of materials will be sufficiently X-ray transparent for most applications. Indeed, a transmittance above 90 percent at 9.25 keV is to be expected for 0.1 mm thick layers of the following materials: BeO, BN, CVD diamond. Many more materials will be suitable if the layer is manufactured by vapour deposition, by which thicknesses below 10 μm can be readily achieved. At higher energies than 9.25 keV, a wide range of further electric insulation layers (a layer being a specific thickness of a specific material) will be available. $SiO_2$ and $Al_2O_3$ are generally suitable for use as an electrically insulating layer 74. The electrically insulating layer 74 may be produced by vapour deposition on another layer of the window element 70, or by spraying, sputtering or doctor-blading onto a substrate or another layer. It may also consist of a prefabricated film.

The heater layer 72 may consist of a conductive material which is X-ray transparent at the relevant thickness, such as graphite or preferably glassy carbon foil having a thickness around 100 μm or preferably less. It may be deposited onto the electrically insulating layer by spraying or by vapour deposition. The spraying or vapour deposition may be executed through a masking film, so that a non-solid grid of electric connections is defined; this may provide good control of the current pattern and thus of the distribution of heating power. A prefabricated heater layer, obtained e.g. by punching an electrically conductive film, may be bonded onto the electrically insulating layer 74.

The charge-drain layer 76 may consist of an electrically conductive material which is X-ray transparent at the relevant thickness. Conductive or semi-conductive materials with a relatively low vapour pressure, relatively high melting point and fair corrosion resistance against hot molten metal are preferred. Carbon, such as graphite, diamond or amorphous carbon is very suitable. Thin layers of Cr, Ni or Ti are fairly suitable. Relatively thinner layers of refractory metals (including Nb, Mo, Ta, W, Re) are suitable, especially with regard to corrosion resistance. The charge-drain layer 76 may be formed on top of the electrically insulating layer 74 by spraying the material emulsified or dissolved in a solvent onto the layer 74, by carrying out vapour deposition or by some other method. To achieve its function, the charge-drain layer 74 is to be electrically connected; it is advantageous to provide an electrical connection that has low thermal conductivity so that the ohmic heating of the secondary window element 70 can be run in an energy-economical fashion.

The secondary window element 70 may be assembled into its final three-layered structure by bonding or welding together prefabricated layers. As has been outlined above, the layers may also be formed one on top of the other in a suitable order. In designing the secondary window element 70, the materials are to be chosen both with regard to their individual properties and to their compatibility as a three-layered laminate; this may include matching their coefficients of thermal expansion and assessing the thermal and/or mechanical wear after a large number of load cycles.

Figure 4:
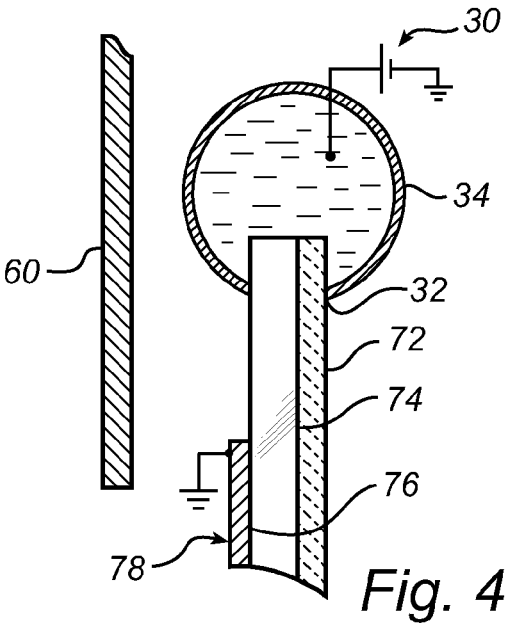
FIGS. 4 and 5 show two preferable methods of securing a secondary window element electrically and mechanically, in accordance with embodiments of the present invention.

FIG. 4 is a detailed view of the top edge of the secondary window element 70 and a vertical portion of the screen 60. FIG. 4 illustrates an advantageous way of connecting the secondary window element 70 electrically and mechanically to other parts of the X-ray window. The edge of the window element 70, namely the electrically insulating layer 74 and the heater layer 72 as a compound element, is inserted into a slit 32 in a reservoir 34 containing electrically conductive liquid. The liquid is electrically connected to the current source 30 and the reservoir 34 is mechanically secured to a part of the window, such as the screen and/or the housing 44, possibly via a spacer. As explained in WO 2010/083854, a connection of this type allows the window element 70 to expand thermally.

Figure 5:
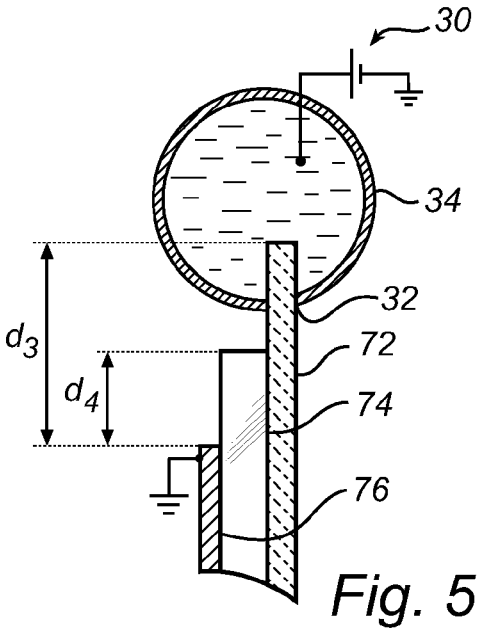

FIG. 5 shows a variation to the embodiment appearing in FIG. 4. Here, the heater layer 72 projects a distance $d_3>0$ outside the rest of the secondary window element 70 and forms the edge of the element 70, at least at this edge of the window element 70. It is then easy to insert the heater layer 72 into the slit 32 of the reservoir 34 and obtain the desired electric connection. The electrically insulating layer 74 extends a distance $d_4 \geq 0$ outside the charge-drain layer 76. This distance may be zero, but is advantageous to design the insulating layer 74 so that it extends a positive distance $d_4$ to further decrease the risk of a short circuit forming between the heater layer 72 and the charge-drain layer 76.

Figure 6:
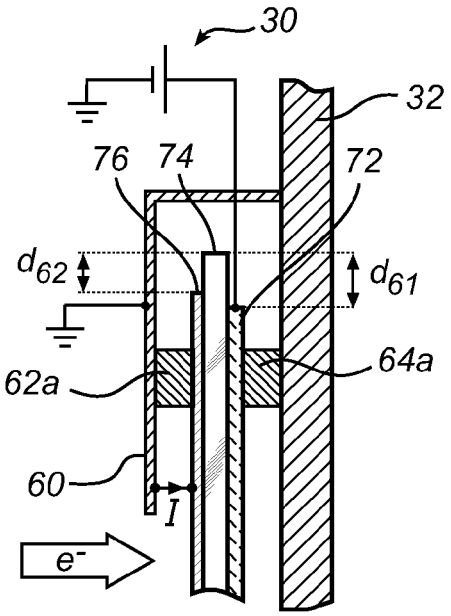
FIGS. 6 and 7 show two preferable methods of connecting charge-drain layers of the secondary window element to a screen.
Figure 7:
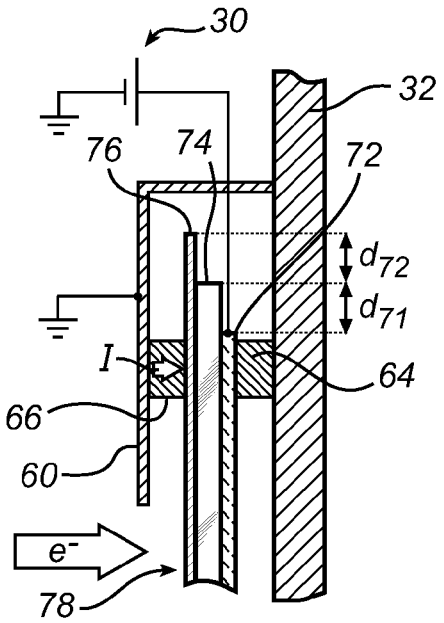

FIGS. 6 and 7 illustrate two further ways of connecting the charge-drain layer 76 electrically, as well as two further layer configurations of the secondary window element 70. In FIG. 6, the electrically insulating layer 74 extends the furthest and constitutes the edge of the element 70. More precisely, it extends a distance $d_{61}$ from the heater layer 72 and a distance $d_{62}$ from the charge-drain layer 76. It will be beneficial to the electrical insulation of the conductive layers 72, 76 if the distances $d_{61}$, $d_{62}$ do not go below a least positive value anywhere around the boundary of the window element 70, whereby the conductive layers 72, 76 are spaced apart.

It is the charge-drain layer 76 that extends up to the edge of the window element 70 shown in FIG. 7. At this edge, the electrically insulating layer 74 is shorter than the charge-drain layer 76 by a transversal distance $d_{72}$, and the heater layer 72 is shorter than the electrically insulating layer 74 by a distance $d_{71}$. As already noted, the electrical insulation will to some extent depend on the least values of these distances.

As to the electrical connections, the charge-drain layer 76 shown in FIG. 6 is connected via an electrically conductive filament to a point on the screen. By allowing the filament to slack, thermal expansion of the secondary window element 70 can be accommodated. To avoid heat losses, ideally, the cross-sectional area of the filament is to be determined as the least value that is able to transport a current corresponding to the charge bombardment per unit time. Further considerations, such as mechanical strength, elasticity and resistance to mechanical or thermal wear may be taken into account.

In FIG. 7, the charge-drain layer 76 is connected via a thermally insulating, electrically conductive spacer 66, which takes the place of the thermally and electrically conductive spacer 62 in previously described embodiments. The electrically conductive spacer 66 allows electric current to flow from the screen 60, which is itself earthed in this embodiment. The spacer 66 preferably has low thermal conductivity to prevent heat from escaping to the screen 60. The spacer 66 may be manufactured by coating a piece of ceramic material with a thin conductive layer, e.g., metalized porcelain. Alternatively, the spacer may consist of a doped ceramic material, such as doped silica, or of some metal(loid) carbide, nitride or oxide.

Figure 8:
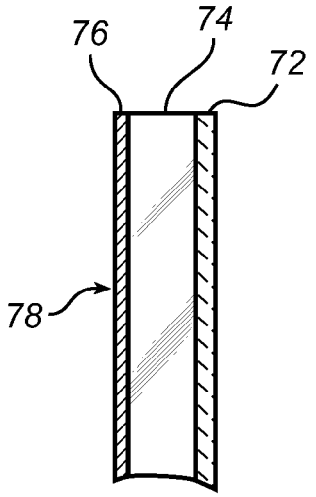
FIGS. 8 and 9 show two preferable layer geometries of a secondary window element.

FIG. 8 illustrates a secondary window element 70 in which the layers 72, 74, 76 are flush with one another at one of the edges, in accordance with an embodiment of the invention.

Figure 9:
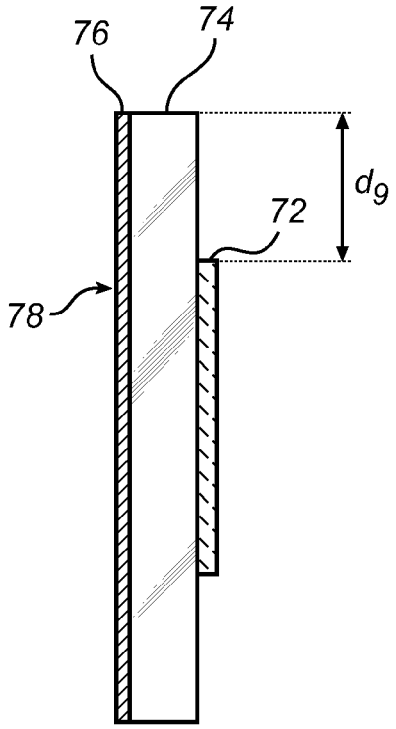

FIG. 9 illustrates, according to another embodiment, a window element 70 having a charge-drain layer 76 and insulating layer 74 of equal size and, additionally, a heater layer 72 extending over a central portion of the downstream side of the element 70. The heater layer 72 may be a conductive film bonded onto the electrically insulation layer 74 or a circuit formed by masked vapour deposition or spraying.

Figure 10:
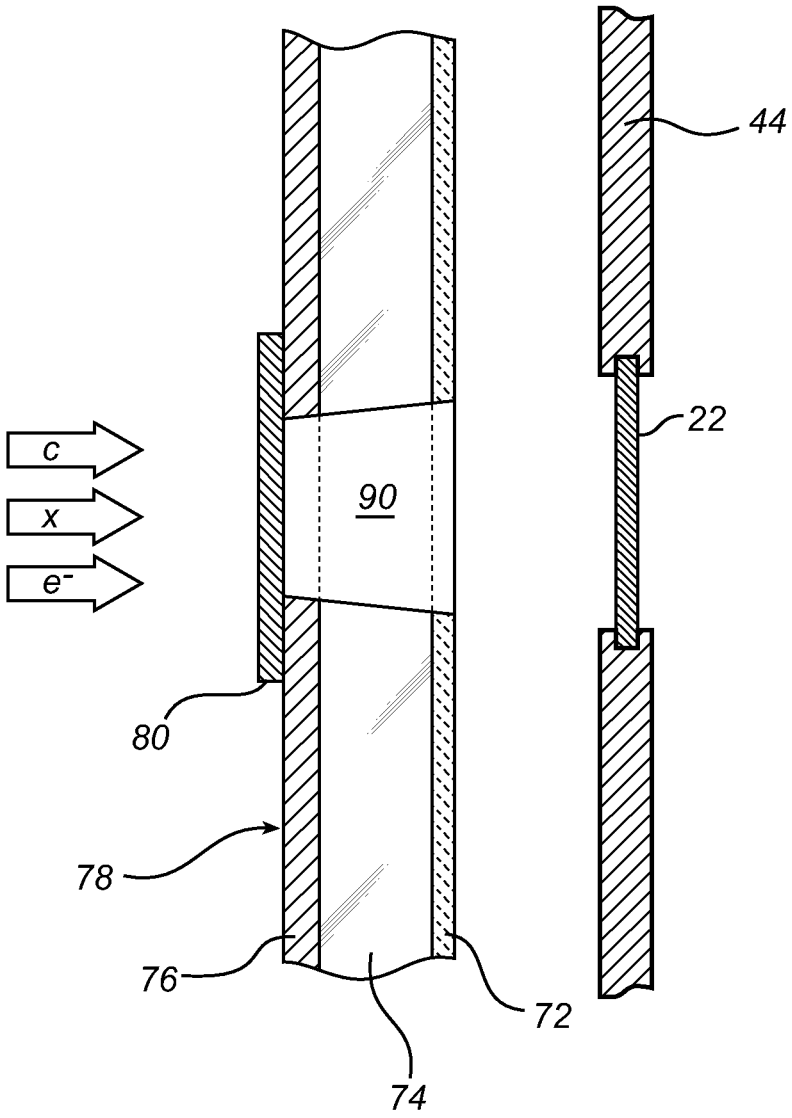
FIG. 10 is a detailed cross-sectional side view of a central portion of an X-ray window in accordance with the invention, wherein the cross section plane intersects an covered axial hole through the secondary window element.

FIG. 10 shows a secondary window element 70 having at least one layer 72, 74, 76 that is not X-ray transparent. Instead, to allow X rays to pass, the window element 70 comprises an axial hole 90 covered by an X-ray transparent plate 80, which can be heated conductively by means of the heater layer 72. The X-ray transparent plate 80 covers the hole 90 from the upstream side 78, which is advantageous in that debris impinges on—and can be cleaned from—a relatively simple geometry. In variations to this embodiment, the plate 80 may be arranged on the downstream side, which then makes the heat transfer from the heater layer 72 to the plate 80 more efficient.

While the invention has been illustrated and described in detail in the drawings and foregoing description, such illustration and description are to be considered illustrative or exemplary and not restrictive; the invention is not limited to the disclosed embodiments. For instance, the secondary window element may be embodied as a four-layered entity comprising a charge-drain layer facing the reduced pressure region, an insulating layer, a heater layer and then a further insulating layer facing the intermediate region.

Other variations to the disclosed embodiments can be understood and effected by those skilled in the art in practicing the claimed invention, from a study of the drawings, the disclosure and the appended claims. Any reference signs in the claims should not be construed as limiting the scope.

The invention claimed is:

1. An X-ray window for separating an ambient pressure region from a reduced pressure region, the window comprising:

a primary X-ray-transparent window element separating the ambient pressure region from an intermediate region;

a secondary window element separating the intermediate region from the reduced pressure region, which secondary window element comprises a side facing the reduced pressure region for receiving a contaminant depositing thereon; and heating means for applying an electric voltage between areas of said secondary window element for thereby evaporating contaminant having deposited thereon, wherein said secondary window element comprises:

an electrically insulating layer;

a charge-drain layer, which faces the reduced pressure region and is connected to a charge sink; and a heater layer, which is electrically insulated from the charge-drain layer, wherein said areas, between which the voltage is applied, are located in the heater layer.

2. The X-ray window of claim 1, further comprising a screen, at least partially surrounding said secondary window element on the side facing the reduced pressure region, said screen being electrically conducting and connected to a charge sink.

3. The X-ray window of claim 2, wherein the charge-drain layer is completely surrounded by the screen and overlaps by a first distance with the screen.

4. The X-ray window of claim 2, wherein the screen and said secondary window element are thermally insulated from one another.

5. The X-ray window of claim 4, further comprising a thermally insulating spacer arranged between the screen and the charge-drain layer of the secondary window element and being in electric contact with both.

6. The X-ray window of claim 5, wherein the thermally insulating spacer contains one of the following materials:

metalized alumina, beta-alumina, doped silica, a doped ceramic material, a metalized ceramic material.

7. The X-ray window of claim 4, further comprising:

a thermally and electrically insulating spacer arranged between the screen and the secondary window element; and an electrically conductive filament connecting the charge-drain layer with the screen.

8. The X-ray window of claim 7, wherein the thermally and electrically insulating spacer contains a glass-ceramic material, preferably one containing $Al_2O_3$.

9. The X-ray window of claim 1, wherein the heater layer contains one of the following materials:

graphite, pyrolytic carbon.

10. The X-ray window of claim 1, wherein said electrically insulating layer contains one of the following materials:

diamond, $SiO_2$,

BeO, $Al_2O_3$,

BN.

11. The X-ray window of claim 1, wherein:

the charge-drain layer extends at most over the electrically insulating layer; and the heater layer extends at least a second distance outside the charge-drain layer, at least over a portion of a boundary of the second window element.

12. The X-ray window of claim 11, wherein a portion of the boundary of the heater layer is secured by being inserted into a slit in a reservoir containing electrically conducting liquid.

13. The X-ray window of claim 11, wherein:

the heater layer extends at most over the electrically insulating layer; and the charge-drain layer extends at least a third distance outside the heater layer, at least over a portion of the boundary.

14. The X-ray window of claim 13, wherein a portion of the boundary of the charge-drain layer is secured by being inserted into a slit in a reservoir containing electrically conducting fluid.

15. The X-ray window of claim 13, wherein the electrically insulating layer extends at least a fourth distance outside the heater layer and at least a fifth distance outside the charge-drain layer, at least over a portion of the boundary.

16. The X-ray window of claim 1, wherein the charge-drain layer contains one of the following materials:

graphite, diamond, amorphous carbon, chromium, nickel, titanium, a refractory metal.

17. The X-ray window of claim 1, wherein the secondary window element is X-ray-transparent.

18. The X-ray window of claim 1, wherein the layers of the secondary window element define at least one axial hole, which is covered by an X-ray-transparent element.

19. An X-ray-source housing comprising:

a gas-tight housing; and the X-ray window of claim 1, provided in an outer wall of said housing.

20. An X-ray source comprising:

the X-ray-source housing of claim 19;

an electron source provided inside the housing; and a liquid-jet electron target provided inside the housing.

* * * * *